US010513390B2

(12) United States Patent
Abang, Jr.

(10) Patent No.: US 10,513,390 B2
(45) Date of Patent: Dec. 24, 2019

(54) BIN

(71) Applicant: Robert Owan Abang, Jr., Cleveland, OH (US)

(72) Inventor: Robert Owan Abang, Jr., Cleveland, OH (US)

(73) Assignee: Robert Owan Abang, Jr., Tampa, FL (US)

( * ) Notice: Subject to any disclaimer, the term of this patent is extended or adjusted under 35 U.S.C. 154(b) by 265 days.

(21) Appl. No.: 15/461,775

(22) Filed: Mar. 17, 2017

(65) Prior Publication Data

US 2018/0162638 A1 Jun. 14, 2018

Related U.S. Application Data

(60) Provisional application No. 62/432,614, filed on Dec. 11, 2016.

(51) Int. Cl.
*B65F 1/06* (2006.01)
*B65F 1/16* (2006.01)

(52) U.S. Cl.
CPC ..... *B65F 1/06* (2013.01); *B65F 1/163* (2013.01)

(58) Field of Classification Search
CPC ..... B65F 1/04; B65F 1/06; B65F 1/08; B65F 1/085; B65F 1/163; B65D 21/0233; B65D 21/086
USPC ..... 220/495
See application file for complete search history.

(56) References Cited

U.S. PATENT DOCUMENTS 5,033,641 A * 7/1991 Martin ..... B65F 1/0046 220/527
RE33,842 E * 3/1992 Ebentheuer ..... B65B 67/1233 248/97
5,092,105 A * 3/1992 Bish-Shin ..... B65B 67/12 53/373.7
5,183,226 A * 2/1993 Brooks ..... B65B 67/1205 248/97
5,183,228 A * 2/1993 Curry ..... B65F 1/06 248/100
5,190,183 A * 3/1993 McNaughton ..... B65F 1/06 220/23.83
5,190,252 A * 3/1993 Schrager ..... B65F 1/06 248/97
5,238,139 A * 8/1993 Bisceglia ..... B65F 1/06 220/495.09

(Continued)

FOREIGN PATENT DOCUMENTS

DE 9310479 U1 * 9/1993 ..... B65F 1/06

*Primary Examiner* — Joshua E Rodden

(57) ABSTRACT

The current invention relates to a bin used in combination with a liner for various purposes, including but not limited to the disposal of trash and the collection of recycled material. The bin having an exterior surface, an interior surface, a body, a closed bottom end, an open top end, and an interior chamber. The bin including at least a slideable top portion allowing for the top opening of the bin to be adjusted in periphery thereby enabling liners of various sizes to be secured in the interior chamber of the bin. In addition, a bin including an adjustable bin lid member within a bin lid enabling liners of various sizes to be secured in the interior chamber of the bin. Furthermore, a bin including a vertical moving floor plate within the interior chamber of the bin for supporting liners of various lengths.

24 Claims, 20 Drawing Sheets

(56) References Cited

U.S. PATENT DOCUMENTS

| | | | | | |
|---|---|---|---|---|---|
| 5,487,551 | A * | 1/1996 | Kennedy | B62B 1/14 | 248/100 |
| 5,803,299 | A * | 9/1998 | Sealy, Jr. | B65F 1/062 | 220/495.07 |
| 6,164,607 | A * | 12/2000 | Hawkes | B65B 67/12 | 248/97 |
| D449,912 | S * | 10/2001 | Henriksson | D34/6 | |
| 6,446,919 | B1 * | 9/2002 | Tsui | B65B 67/1205 | 248/100 |
| 6,629,622 | B1 * | 10/2003 | Abzaletdinov | B65F 1/06 | 206/459.5 |
| 6,676,092 | B2 * | 1/2004 | Tsai | B65F 1/1415 | 248/149 |
| 7,284,732 | B1 * | 10/2007 | Lopa | B65B 67/1233 | 248/101 |
| 8,240,621 | B1 * | 8/2012 | Singh | B65B 67/1238 | 220/495.11 |
| 8,720,833 | B2 * | 5/2014 | Jack | B65B 67/04 | 248/100 |
| 2008/0017648 | A1 * | 1/2008 | Scott | B65F 1/06 | 220/495.06 |
| 2010/0044380 | A1 * | 2/2010 | Nallakrishnan | B65F 1/0006 | 220/495.08 |
| 2012/0060706 | A1 * | 3/2012 | Brown | B30B 9/3053 | 100/211 |
| 2015/0274379 | A1 * | 10/2015 | Hall | B65D 21/086 | 220/287 |
| 2016/0137412 | A1 * | 5/2016 | Capetillo | B65F 1/085 | 220/529 |
| 2018/0282058 | A1 * | 10/2018 | Rana | B65F 1/06 | |
| 2019/0152698 | A1 * | 5/2019 | Zhao | B65F 1/1607 | |

* cited by examiner

BIN

CROSS REFERENCE TO RELATED APPLICATION

This application claims the benefit of U.S. Provisional Patent Application No. 62/432,614 filed Dec. 11, 2016 by Robert Owan Abang jr, and incorporated in its entirety herein by reference.

DESCRIPTION

Technical Field of the Invention

The present invention relates to bins which are commonly used in combination with a liner in a variety of applications, particularly but not limited to the disposal of trash and the collection of recycled material. These bins come in various shapes and sizes, and are usually made of forms of metal, plastic, aluminum, steel, a combination of and/or other suitable material.

Background of the Invention

For years disposable bags used for bagging groceries, shopping and more are commonly being re-used in combination with bins as liners. These liners are inserted into the bin and later removed from the bin and used to carry the accumulated contents to dispose of or recycle into a larger container or at a location for disposal (e.g. into a dumpster or at the curb for pickup by a trash/recycling collection service). Majority of these liners however cannot be inserted into standard size bins because the liners are too small and therefore the top opening of the liner is unable to go around the top portion of the bin. Some other liners are wide enough to be inserted into a bin but these liners however after being inserted into the bin most times fall into the bin after trash or other material have been thrown in them because they are too short to reach the floor of the bin. Therefore, these liners don't function properly because they are either too small to go around the top portion of the bin or too short to reach the floor of the bin. Due to this, a lot of consumers instead of making a second productive use out of these liners end up just disposing of them too quickly. There is therefore a need for an improved bin capable of accommodating liners of all sizes. Current bins available today do not address this need.

DESCRIPTION OF THE PRIOR ART

Bins for disposal of trash and collection of recycled material typically involve the use of a liner. These liners come in various sizes to be inserted into the interior chamber of the bin. Most bins also come with bin lids, which are utilized as just a cover for the bins for covering the contents disposed within the interior chamber of the bin. However due to the rigid structure of the bin and bin lids, liners of different sizes cannot all fit in the interior chamber of the bin because the top opening of the liner is unable to go around the top portion of the bin, and therefore cannot be effectively used as a liner:

U.S. Pat. No. 7,624,915 issued to Dembowiak et al describes a recycling center having a receiving chamber. A bag support having a first rail, second rail, and support bar is slidably mounted to the walls of the receiving chamber. The bag support is movable between a first position wherein the bag support is within the receiving chamber, and a second position wherein the bag support is at least partially outside the receiving chamber. The invention does not relate to a bin with the ability to extend and retract the top upper portion of the bin, or an adjustable bin lid for liners of different sizes to fit in the interior chamber of the bin.

U.S. Pat. No. 8,042,703 issued to Dembowiak describes a recycling center having a receiving chamber. A bag slide comprising of a first rail, second rail, at least a rod extending between the first and second rails, and pivotable bag retainers slidably mounted to the walls of the receiving chamber. The bag slide is movable between a first position wherein the bag support is within the receiving chamber and a second position wherein the bag support is at least partially outside the receiving chamber. The invention does not relate to a bin with the ability to extend and retract the top upper portion of the bin, or an adjustable bin lid for liners of different sizes to fit in the interior chamber of the bin.

U.S. Pat. No. 8,302,916 issued to Dembowiak et al describes a bag support comprising of a first bar, second bar, at least a support extending between first and second bar, and pivotable bag retainers extending from the bar to support a bag. The bag retainers pivotable between a first position and a second bag retaining position. The invention does not relate to a bin with the ability to extend and retract the top upper portion of the bin, or an adjustable bin lid for liners of different sizes to fit in the interior chamber of the bin.

U.S. Pat. No. 5,803,299 issued to Sealy Jr describes a bag support insert with telescoping members mounted on the upper edges of a container with bag support pegs for supporting a trash bag. This invention is not part of the container and does not relate to a bin with the ability to extend and retract the top upper portion of the bin, or an adjustable bin lid for liners of different sizes to fit in the interior chamber of the bin.

U.S. Patent Application No. 20070062953 issued to Lin describes a trashcan with at least a cover comprised of two parallel sliding portions having a rail and a track to open and close the trashcan. The purpose of this invention is to cover the contents disposed within the bin interior chamber and does not relate to a bin with the ability to extend and retract the top upper portion of the bin, or an adjustable bin lid for liners of different sizes to fit in the interior chamber of the bin.

U.S. Pat. No. 8,378,597 issued to Shek describes a cover assembly comprising of two parts. The first part having an open hole and the second part having guide slots on two sidewalls and a plurality of sliding plates to open and close the hole. The purpose of this invention is to open and close access to the interior chamber of the bin and does not relate to a bin with the ability to extend and retract the top upper portion of the bin, or an adjustable bin lid for liners of different sizes to fit in the interior chamber of the bin.

U.S. Pat. No. 7,290,674 issued to Ledford describes a trash bin comprising of a plurality of lids, a divider member, and bag supporting members pivotally connected to the trash bin. The bottom of the bag supporting members engageable with the top edge portions of a trash bag when the bag supporting member is lowered on to the trash bin to secure the trash bag. The purpose of this invention is to secure a trash bag inserted into a trash bin and does not relate to a bin with the ability to extend and retract the top upper portion of the bin, or an adjustable bin lid for liners of different sizes to fit in the interior chamber of the bin.

None of the above inventions relates to a bin with the ability to extend and retract the top upper portion of the bin or an adjustable bin lid for liners of different sizes to fit in the interior chamber of the bin.

It is further an objective and feature to provide a bin with a vertical movable floor plate. Bins for disposal of trash and collection of recycled material typically involve the use of a liner. These liners come in various lengths to be inserted into the interior chamber of the bin. However, as trash and other material are disposed into the liner and bin, the liner is usually pulled towards the bottom of the bin, especially in situations where the length of the liner is not long enough to be supported by the bottom floor of the bin:

U.S. Patent Applications No. 20130037547 and 20130036924 issued to Ko describes a trashcan having an upper cover with a stepping part that moves down to compress the contents of a trashcan, and a restoring assembly comprising of an elastic element, a transmission element and a pulley to restore the stepping part to the to the upper cover. The purpose of this invention is to compress contents of a trashcan and does not provide a floor plate for supporting a liner inserted in the interior chamber of a bin.

U.S. Patent Application No. 20020056377 issued to Gawlet et al describes a refuse waste compactor having a compression member to compress refuse within a receptacle. The receptacle comprising of a sensor within the receptacle to gauge the level of refuse within the receptacle. The purpose of this invention is to compress contents of a trashcan and does not provide a floor plate for supporting a liner inserted in the interior chamber of a bin.

U.S. Pat. No. 5,645,187 issued to Brown describes a self-ejecting garbage receptacle having a tray within the receptacle moving between a first lowered position and a second raised position by a belt coupled to said tray and coil springs for ejecting said tray. Although this invention comprises of a raised tray within a garbage receptacle, it comprises of a belt and coil springs for the purpose of ejecting garbage within a receptacle.

None of the above inventions relates to a bin that provides a vertical moving floor plate for supporting a liner inserted in the interior chamber of a bin.

BRIEF SUMMARY OF THE INVENTION

The current invention relates to an improved bin used in combination with a liner for various purposes, including but not limited to the disposal of trash and the collection of recycled material. The bin having an exterior surface, an interior surface, a body, a closed bottom end, an open top end, and an interior chamber. The bin comprising of at least a slideable top portion allowing for the top opening of the bin to be adjusted in periphery thereby enabling liners of various sizes to be secured in the interior chamber of the bin.

In addition, a bin comprising of an adjustable bin lid member within a bin lid enabling liners of various sizes to be secured in the interior chamber of the bin.

Furthermore, a bin comprising of a vertical moving floor plate within the interior chamber of the bin for supporting liners of various lengths.

DETAILED DESCRIPTION OF THE EMBODIMENTS OF THE INVENTION

Figure 1:
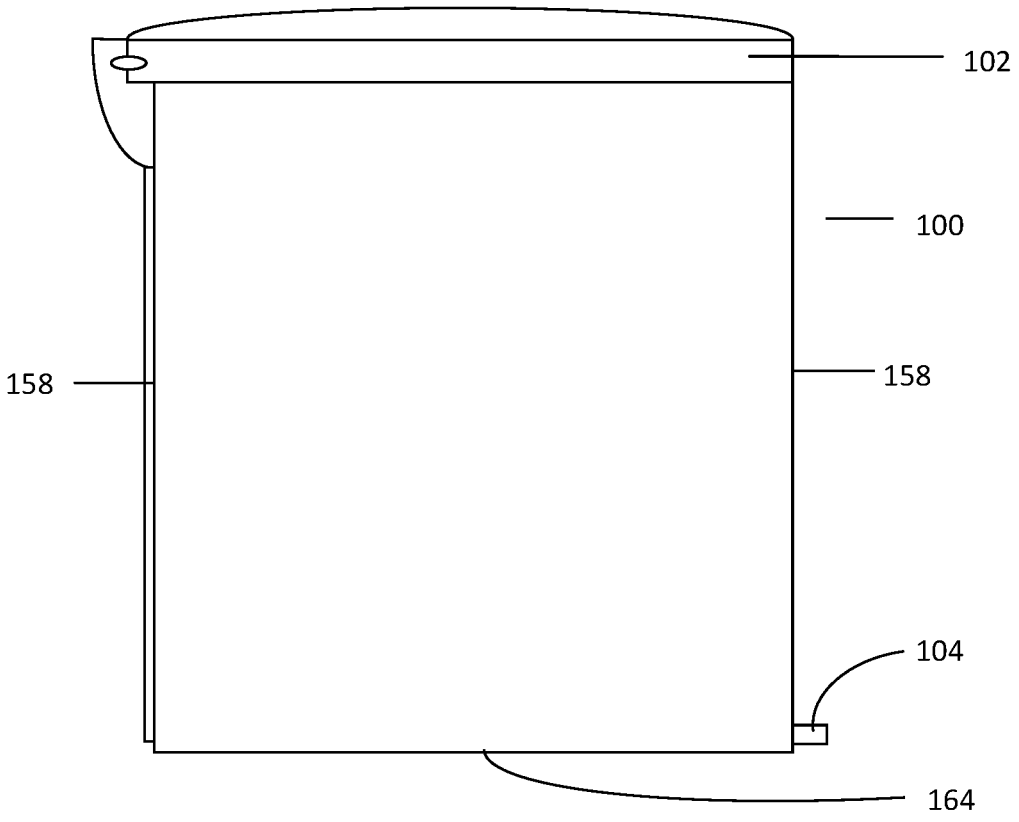
FIG. 1 is a side view of a bin.

Referring to FIG. 1, there is shown a side view of a bin 100 used for the disposal of trash and collection of recycled material. The bin having surrounding wall 158 and a closed bottom end 164 configured to create a base with an interior chamber. A lid 102 is connected to the top of the bin 100. A pedal 104 is configured for activating opening of the lid 102.

Figure 2:
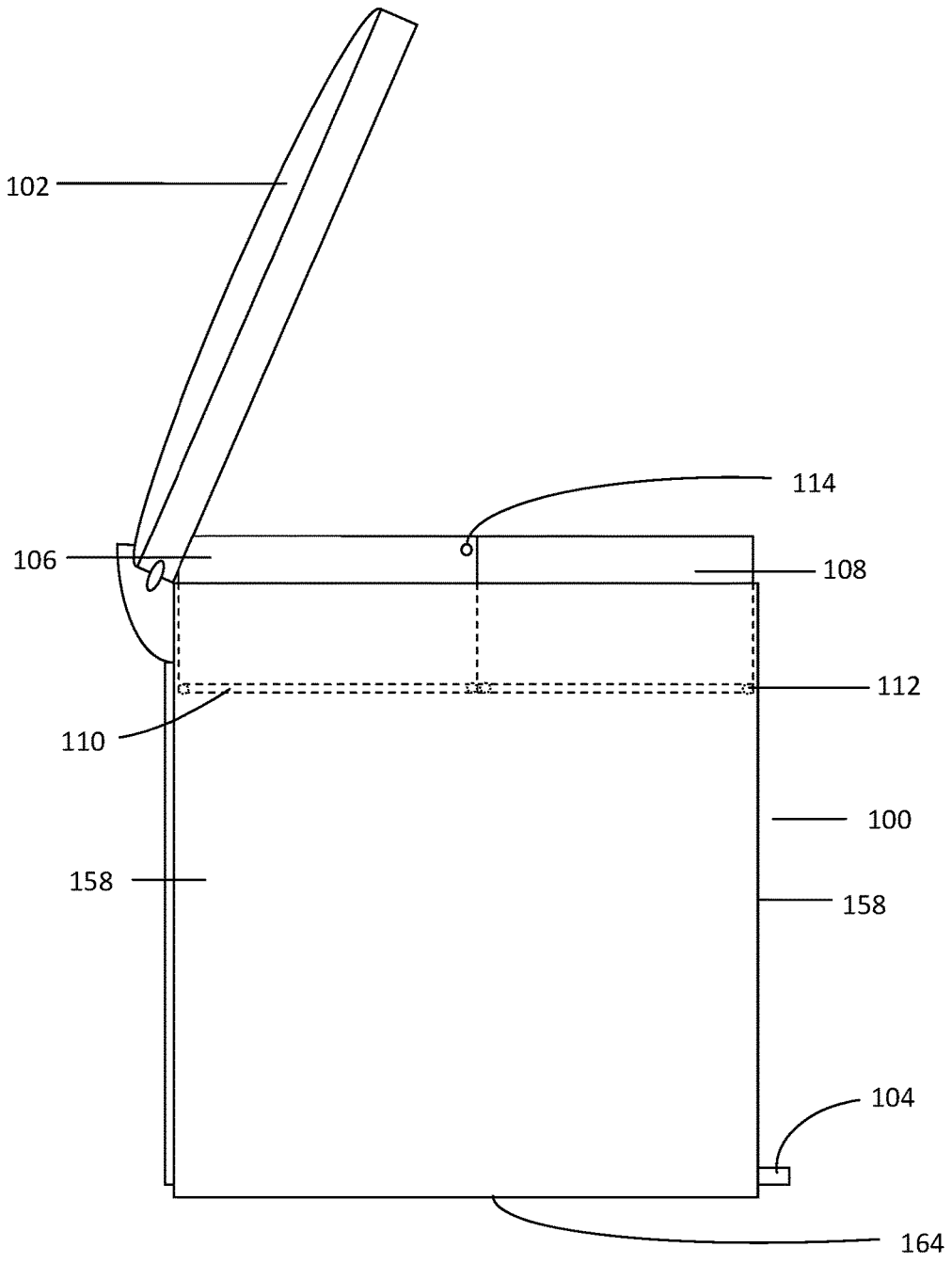
FIG. 2 is a side view of the bin of FIG. 1.

Referring to FIG. 2, there is shown a side view of the bin 100 of FIG. 1. The bin having surrounding wall 158 and a closed bottom end 164 configured to create a base with an interior chamber. A lid 102 is connected to the top of the bin 100. A pedal 104 is configured for activating opening of the lid 102. A slideable telescopic top portion of bin 100 comprising of slideable telescopic member 106 and slideable telescopic member 108 partially configured within the interior chamber of the bin 100. A guide track 110 and rollers 112 are configured within the bin for slideable telescopic member 106 and slideable telescopic member 108 to slide relative to guide track 110. Configured on slideable telescopic member 106 and slideable telescopic member 108 is a lock mechanism 114 to secure the slideable telescopic top portion in a locked position.

Figure 3:
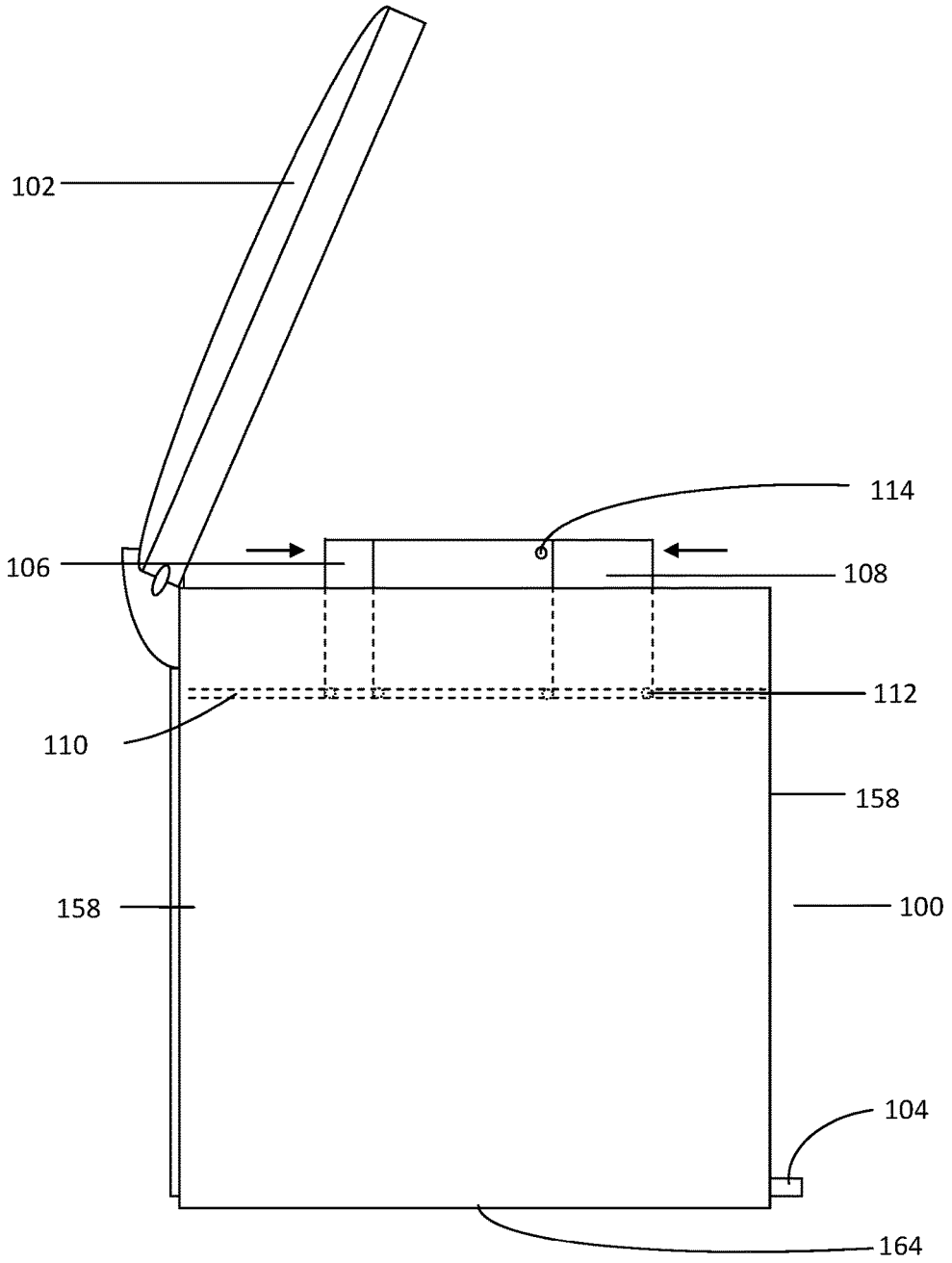
FIG. 3 is a side view of the bin of FIG. 1.

Referring to FIG. 3, there is shown a side view of the bin 100 of FIG. 1. This FIG. includes all of the aspects of FIG. 2 but shows the slideable telescopic member 106 and slideable telescopic member 108 in a retracted position.

Figure 4:
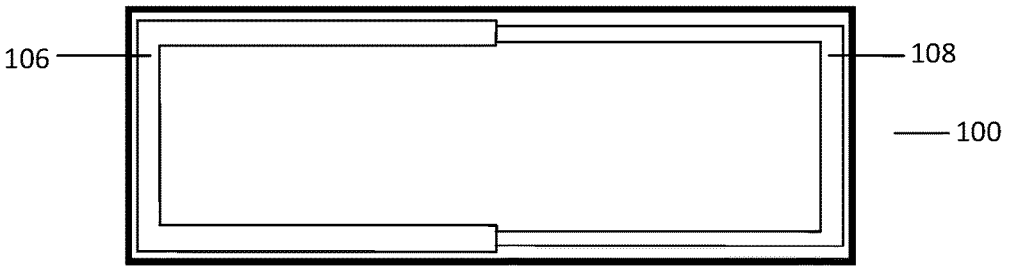
FIG. 4 is a top view of the interior chamber of the bin of FIG. 1.

Referring to FIG. 4, there is shown a top view of the interior chamber of the bin 100 of FIG. 1 with slideable telescopic member 106 and slideable telescopic member 108 in an extended position.

Figure 5:
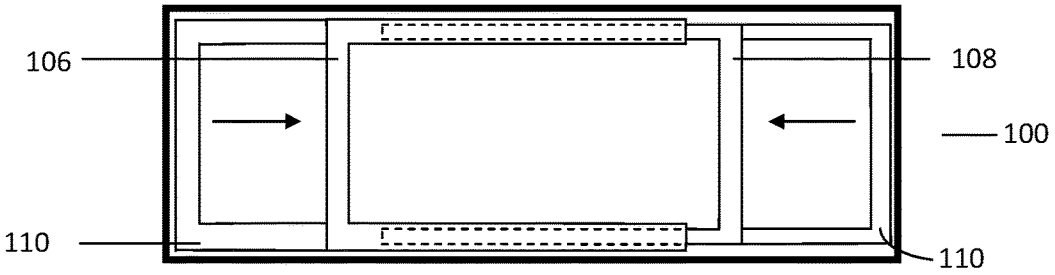
FIG. 5 is a top view of the interior chamber of the bin of FIG. 1

Referring to FIG. 5, there is shown a top view of the interior chamber of the bin 100 of FIG. 1 with slideable telescopic member 106 and slideable telescopic member 108 in a retracted position relative to guide track 110.

Figure 6:
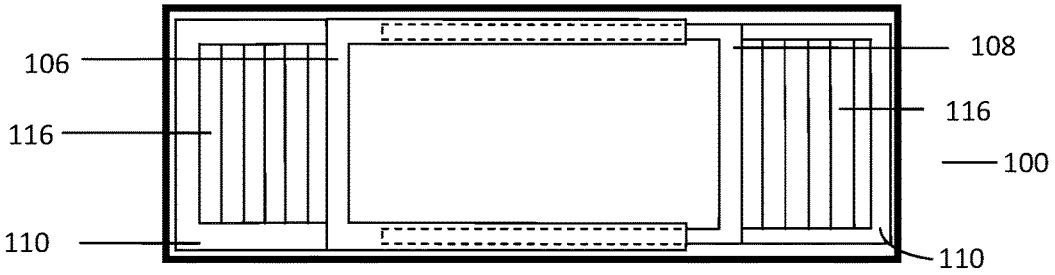
FIG. 6 is a top view of another embodiment of the interior chamber.

Referring to FIG. 6, there is shown another embodiment of a top view of the interior chamber of a bin 100 with slideable telescopic member 106 and slideable telescopic member 108 in a retracted position relative to guide track 110. A plurality of plates 116 is coupled to slideable telescopic member 106 and slideable telescopic member 108. The plurality of plates 116 present in the space between the rest of the bin and the slideable telescopic members 106 and slideable telescopic member 108 when retracted.

Figure 7:
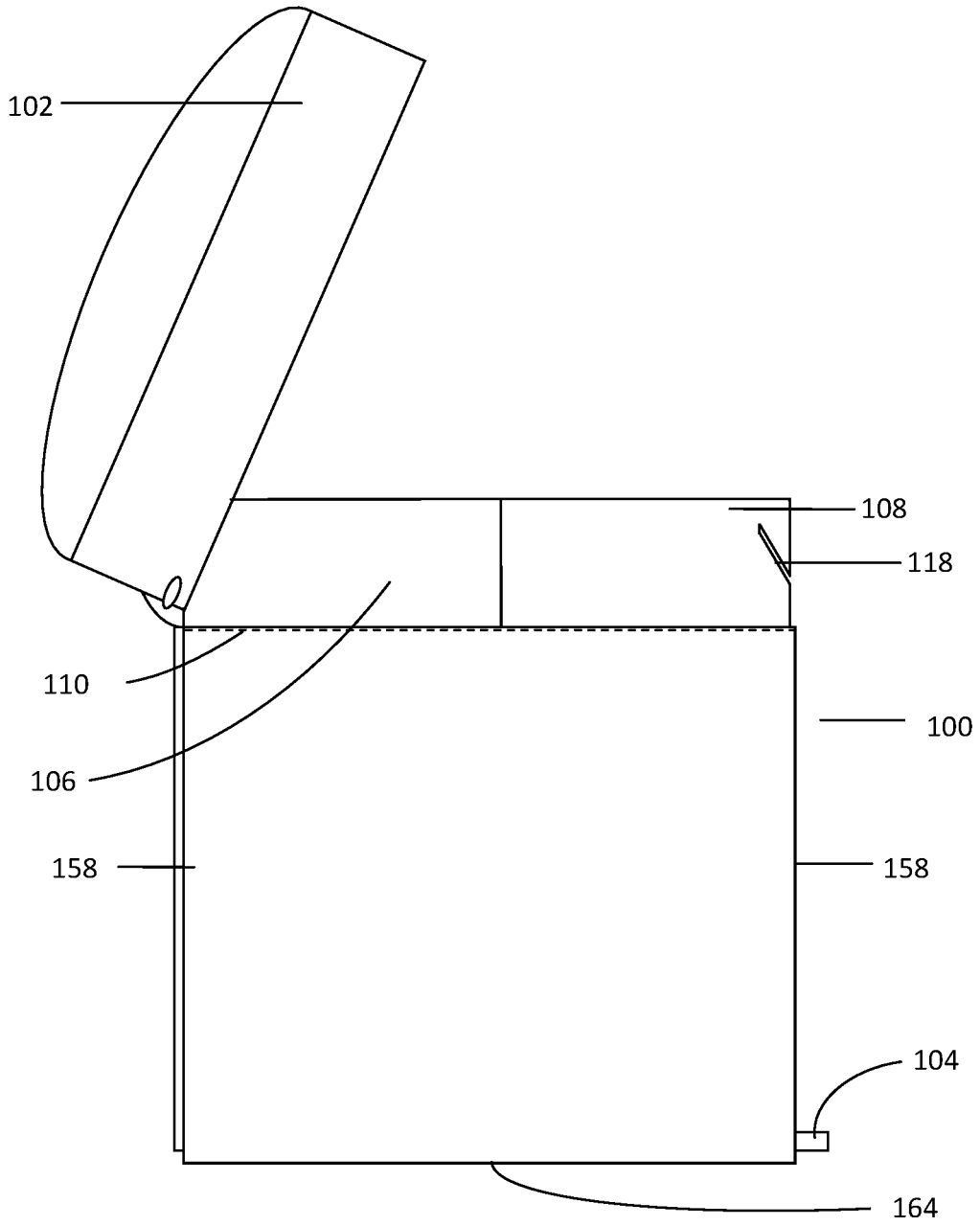
FIG. 7 is a side view of a bin.

Referring to FIG. 7, there is shown a side view of a bin 100. The bin having surrounding wall 158 and a closed bottom end 164 configured to create a base with an interior chamber. A lid 102 is connected to the top of the bin 100. A pedal 104 is configured for activating opening of the lid 102. A slideable telescopic top portion of bin 100 comprising of slideable telescopic member 106 and slideable telescopic member 108 configured on top the bin 100 periphery on guide track 110. Configured on slideable telescopic member 106 and slideable telescopic member 108 is a hooking mechanism 118 for receiving first and second portions of a liner with grab handles.

Figure 8:
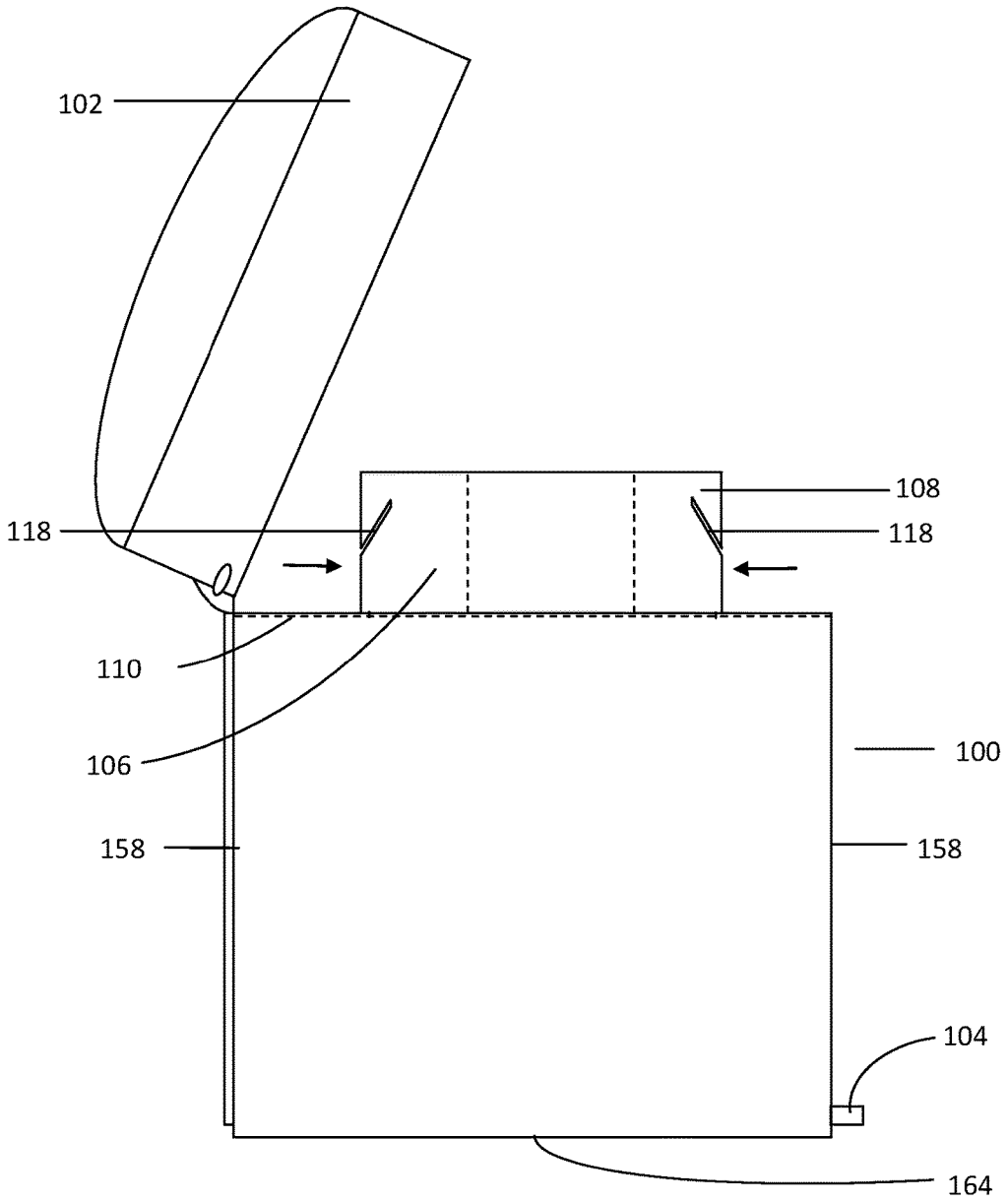
FIG. 8 is a side view of the bin of FIG. 7.

Referring to FIG. 8, there is shown a side view of the bin 100 of FIG. 7. This FIG. includes all of the aspects of FIG. 7 but shows the slideable telescopic member 106 and slideable telescopic member 108 in a retracted position.

Figure 9:
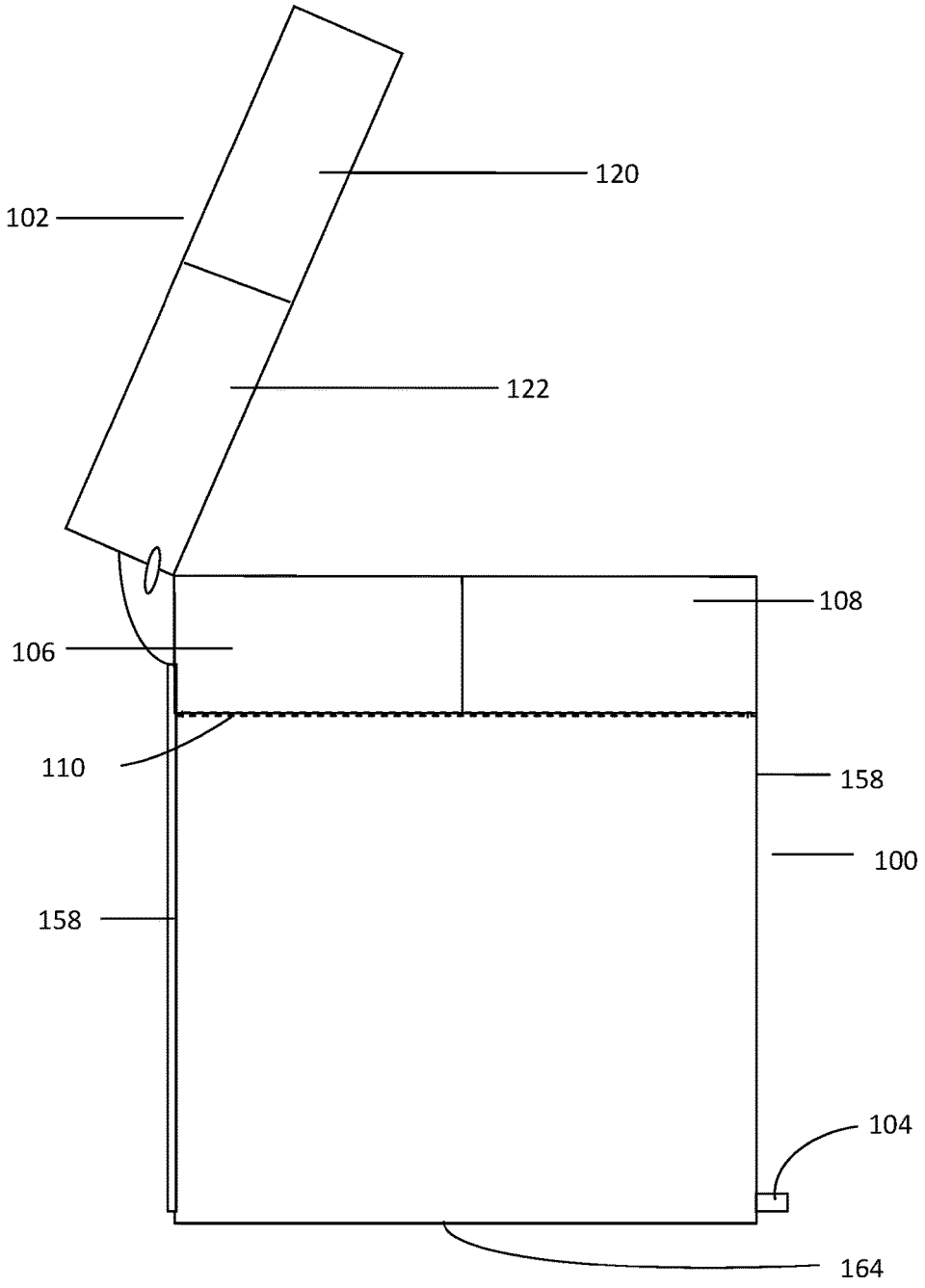
FIG. 9 is a side view of another embodiment of a bin.

Referring to FIG. 9, there is shown another embodiment of a side view of a bin 100. The bin having surrounding wall 158 and a closed bottom end 164 configured to create a base with an interior chamber. A lid 102 is connected to the top of the bin 100. The lid 102 having two slideable telescopic members 120, 122. A pedal 104 is configured for activating opening of the lid 102. A slideable telescopic top portion of bin 100 comprising of slideable telescopic member 106 and slideable telescopic member 108 configured on top the bin 100 periphery on guide track 110.

Figure 10:
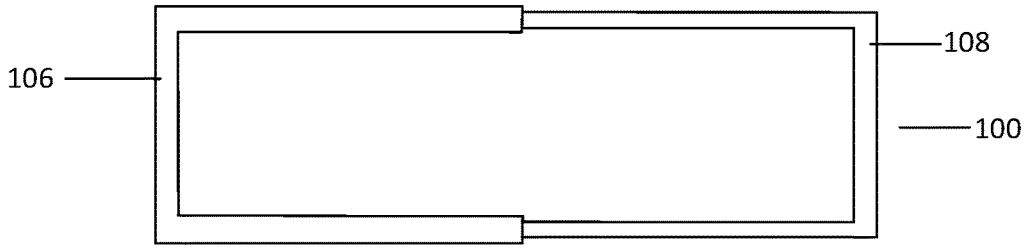
FIG. 10 is a top view of the interior chamber of the bin of FIG. 7.

Referring to FIG. 10, there is shown a top view of the interior chamber of the bin 100 of FIG. 7 with slideable telescopic member 106 and slideable telescopic member 108 in an extended position.

Figure 11:
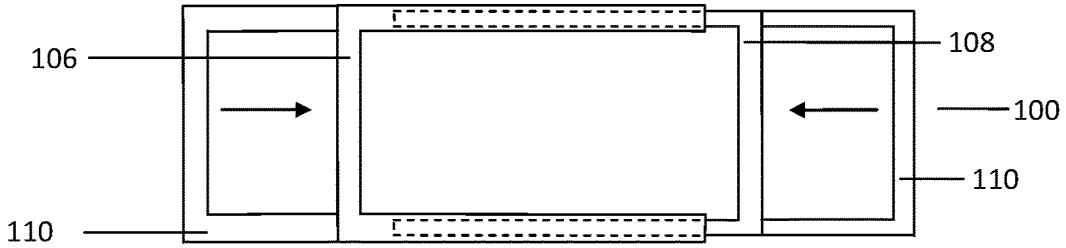
FIG. 11 is a top view of the interior chamber of the bin of FIG. 7.

Referring to FIG. 11, there is shown a top view of the interior chamber of the bin 100 of FIG. 7 with slideable telescopic member 106 and slideable telescopic member 108 in a retracted position relative to guide track 110.

Figure 12:
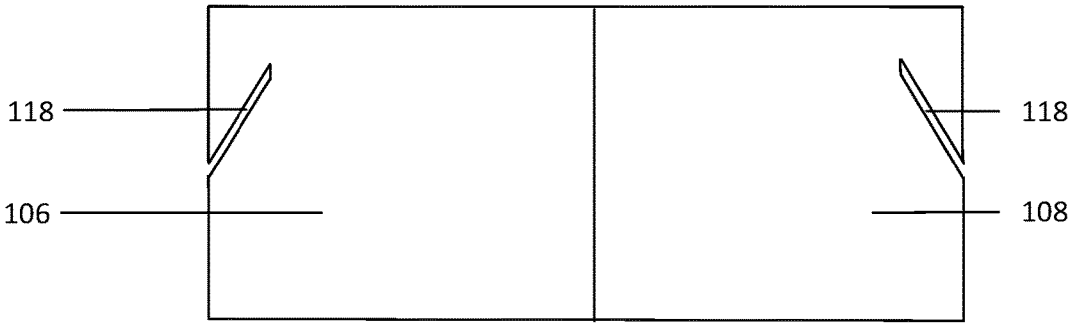
FIG. 12 is a side view of slideable telescopic members.

Referring to FIG. 12, there is shown a side view of slideable telescopic member 106 and slideable telescopic member 108 with hooking mechanism 118 configured on slideable telescopic member 106 and slideable telescopic member 108.

Figure 13:
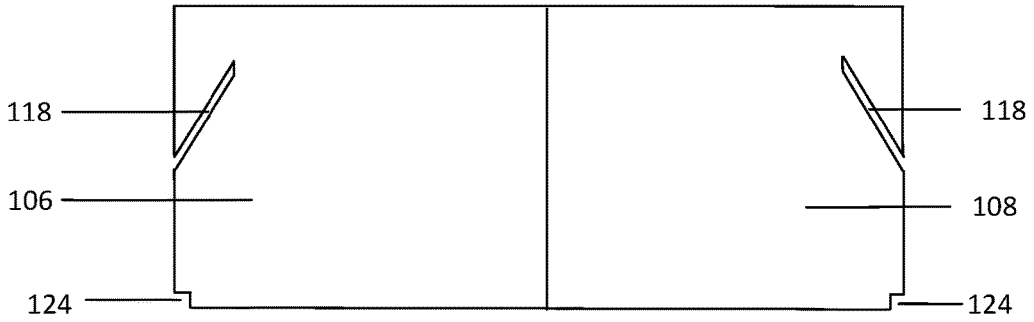
FIG. 13 is a side view of another embodiment of slideable telescopic members.

Referring to FIG. 13, there is shown a side view of another embodiment of slideable telescopic member 106 and slideable telescopic member 108 with hooking mechanism 118 and part of side wall bottom 124 of slideable telescopic member 106 and slideable telescopic member 108 elevated.

Figure 14:
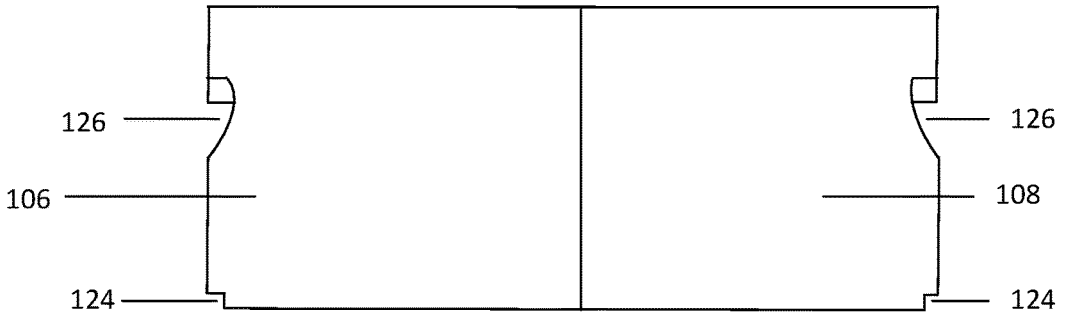
FIG. 14 is a side view of another embodiment of slideable telescopic members.

Referring to FIG. 14, there is shown a side view of another embodiment of slideable telescopic member 106 and slideable telescopic member 108 with handle 126 and part of side wall bottom 124 of slideable telescopic member 106 and slideable telescopic member 108 elevated.

Figure 15:
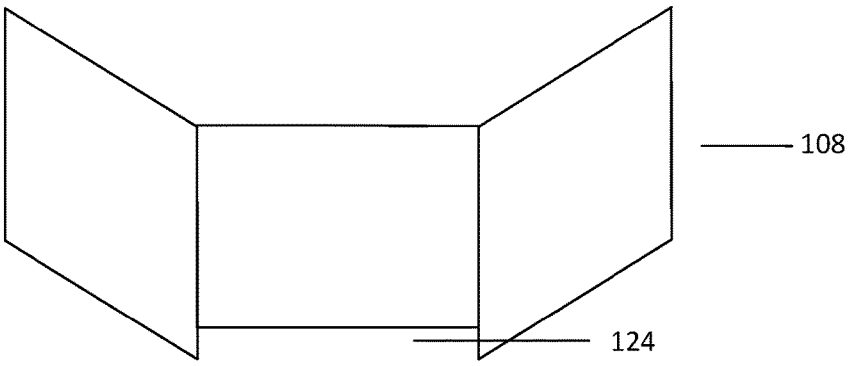
FIG. 15 is a perspective view of a slideable telescopic member.

Referring to FIG. 15, there is shown a perspective view of slideable telescopic member 106, 108 and part of side wall bottom 124 of slideable telescopic member 106, 108 elevated.

Figure 16:
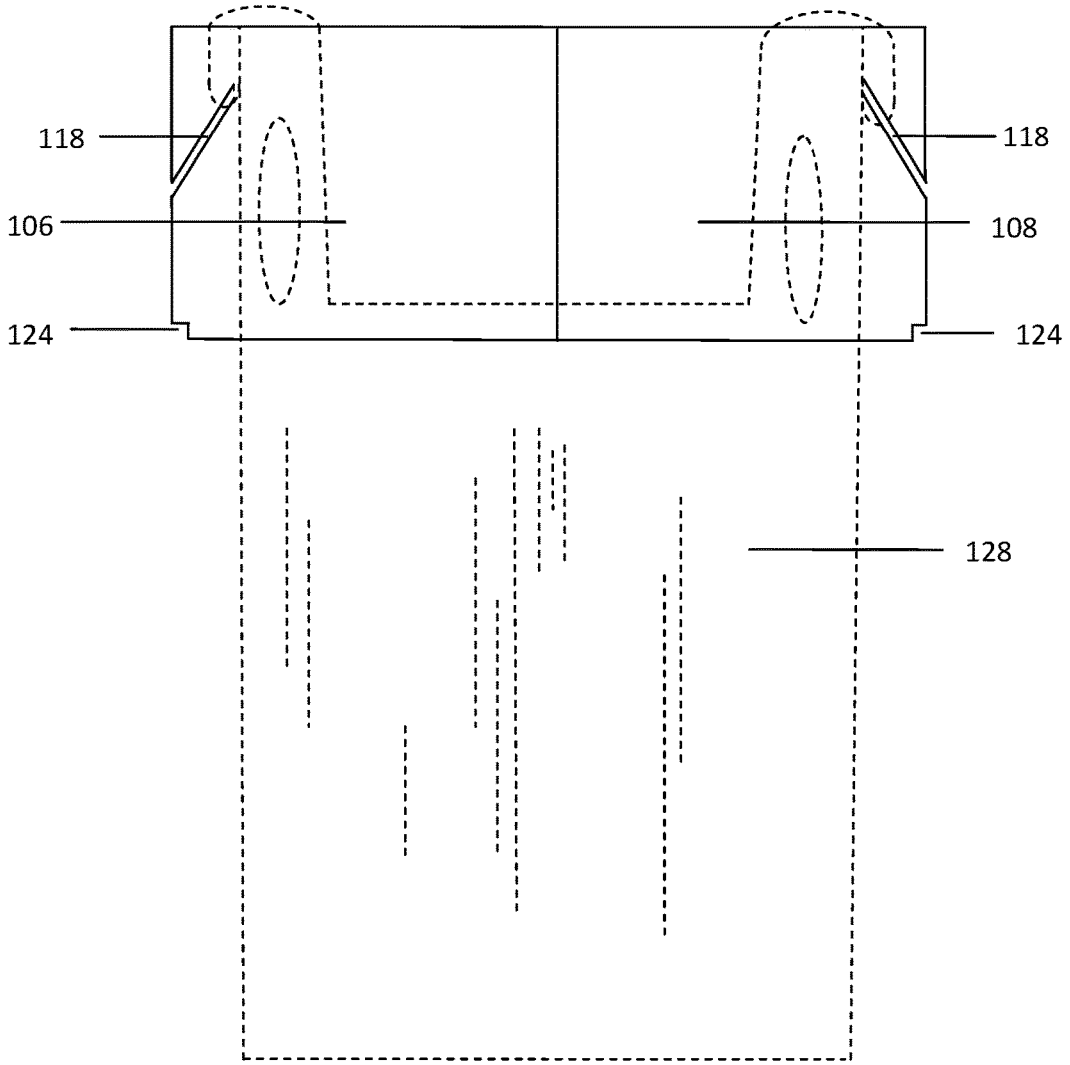
FIG. 16 is a side view of the slideable telescopic members of FIG. 13 engaged with a liner with grab handles.

Referring to FIG. 16, there is shown a side view of the slideable telescopic member 106 and slideable telescopic member 108 of FIG. 13 having part of side wall bottom 124 of slideable telescopic member 106 and slideable telescopic member 108 elevated, wherein a liner 128 with grab handles has been inserted and is being secured by hooking mechanism 118.

Figure 17:
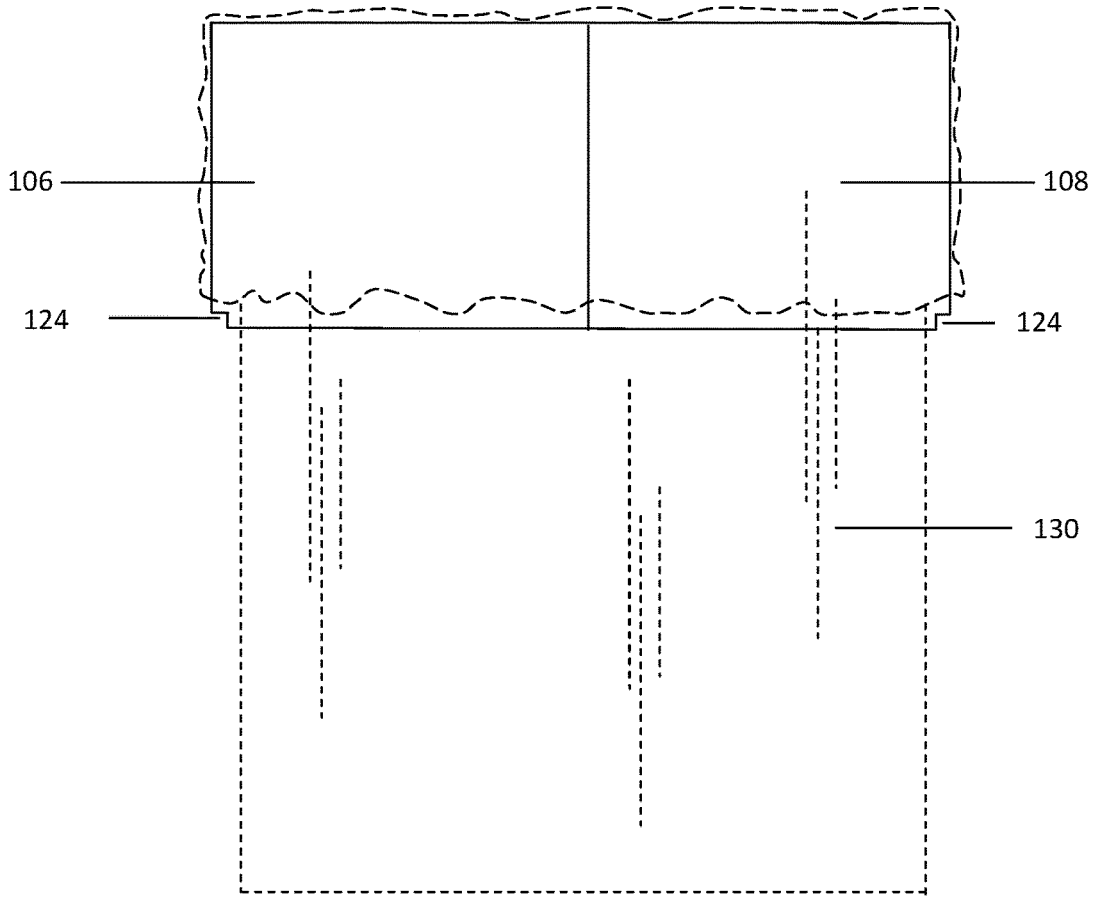
FIG. 17 is a side view of another embodiment of a slideable telescopic top portion engaged with a liner with no grab handles.

Referring to FIG. 17, there is shown a side view of another embodiment of slideable telescopic member 106 and slideable telescopic member 108 having part of side wall bottom 124 of slideable telescopic member 106 and slideable telescopic member 108 elevated, wherein a liner 130 with no grab handles has been inserted.

Figure 18:
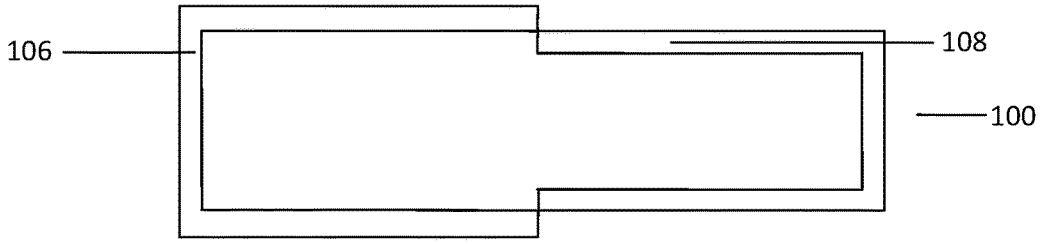
FIG. 18 is a top view of another embodiment of the interior chamber of a bin.

Referring to FIG. 18, there is shown a top view of another embodiment of the interior chamber of a bin 100 with slideable telescopic member 106 and slideable telescopic member 108 in an extended position.

Figure 19:
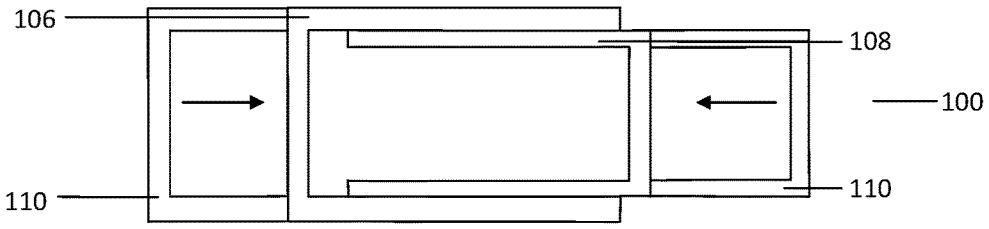
FIG. 19 is a top view of the interior chamber of the bin of FIG. 18.

Referring to FIG. 19, there is shown a top view of the interior chamber of the bin 100 of FIG. 18 with slideable telescopic member 106 and slideable telescopic member 108 in a retracted position relative to guide track 110.

Figure 20:
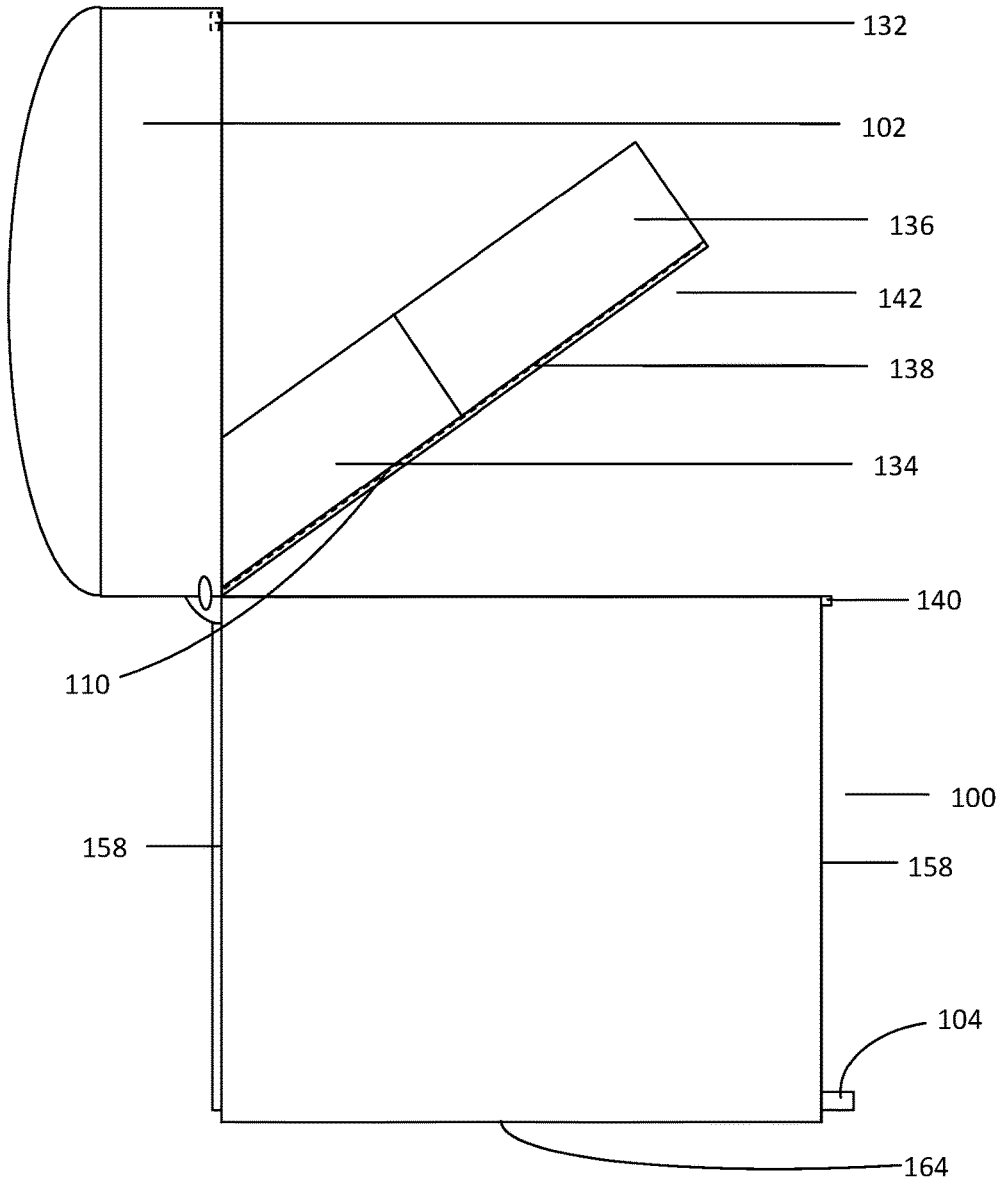
FIG. 20 is a side view of a bin.

Referring to FIG. 20, there is shown a side view of a bin 100. The bin having surrounding wall 158 and a closed bottom end 164 configured to create a base with an interior chamber. A lid 102 is connected to the top of the bin 100. A pedal 104 is configured for activating opening of the lid 102. A lid member 142 is pivotably configured within the lid 102. The lid member 142 comprising of a base member 138 having slideable telescopic member 134 and slideable telescopic member 136 configured on base member 138 of the lid member 142. Guide track 110 is configured on base member 138 of the lid member 142 for engaging slideable telescopic member 134 and slideable telescopic member 136. The bin 100 having a securing mechanism 132 configured on lid 102 to secure lid member 142 within lid 102. The bin 100 further having a securing mechanism 140 configured to secure lid member 142 to the bin 100.

Figure 21:
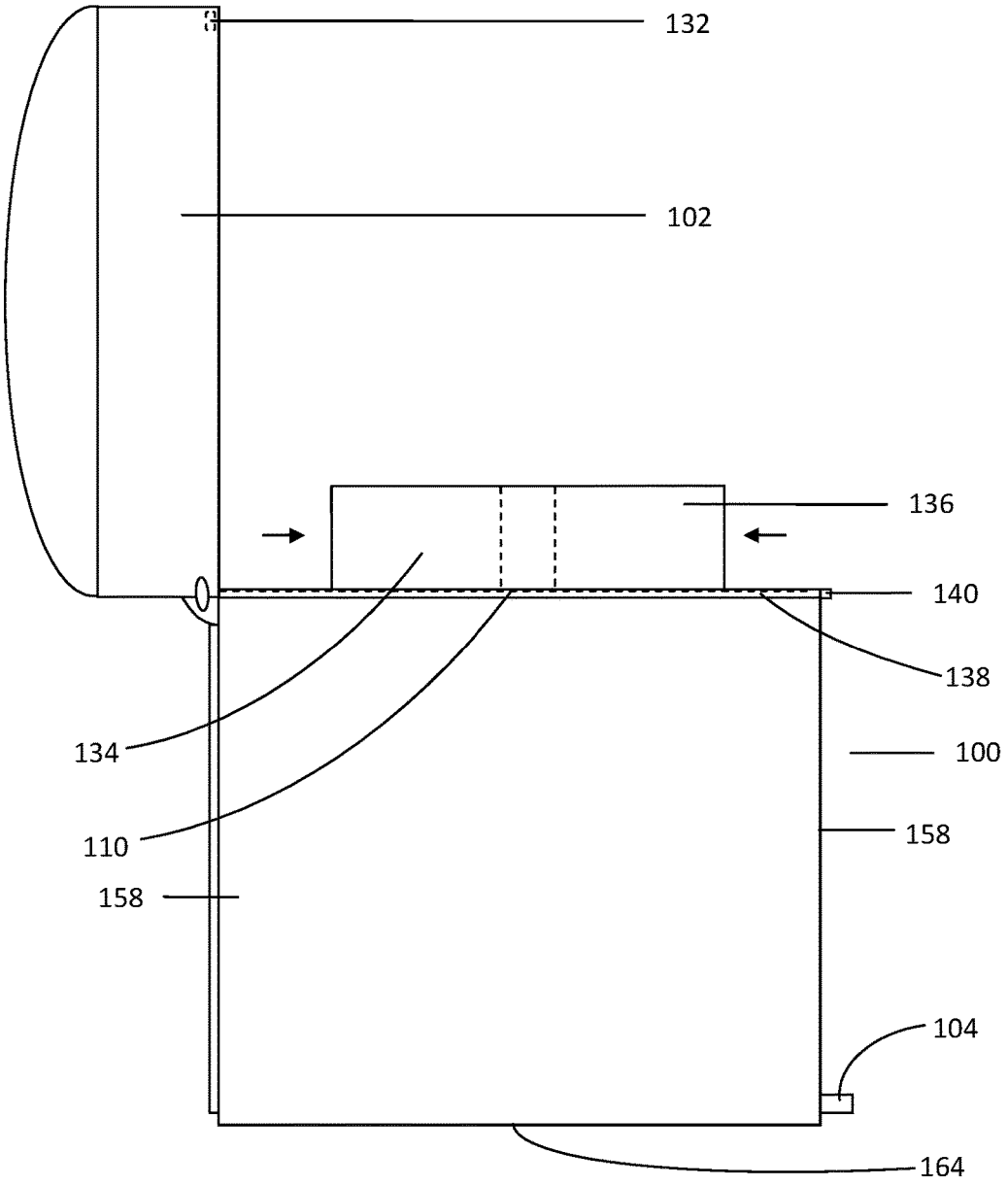
FIG. 21 is a side view of the bin of FIG. 20.

Referring to FIG. 21, there is shown a side view of the bin 100 of FIG. 20. This FIG. includes all of the aspects of FIG. 20 but shows the slideable telescopic member 134 and slideable telescopic member 136 of lid member 142 in a retracted position.

Figure 22:
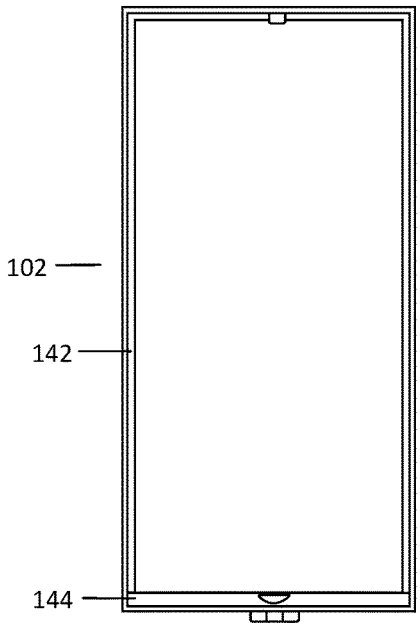
FIG. 22 is a bottom view of a lid.

Referring to FIG. 22, there is shown a bottom view of a lid 102. The lid having lid member 142 within the lid 102. Present on lid 102 is a plurality of plates 144 for concealing the lid member 142 within the lid 102.

Figure 23:
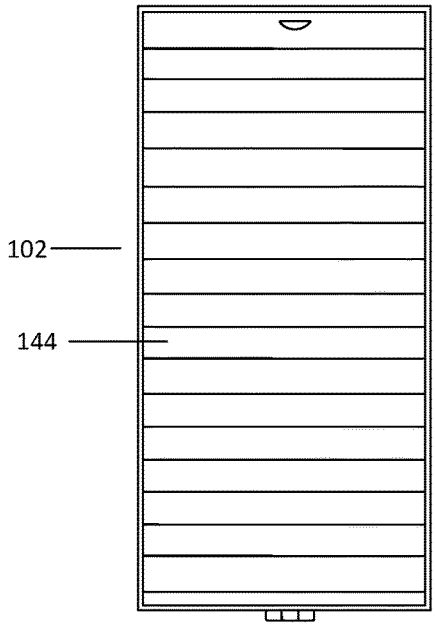
FIG. 23 is a bottom view of the lid of FIG. 22.

Referring to FIG. 23, there is shown a bottom view of the lid 102 of FIG. 22. This FIG. includes all of the aspects of FIG. 22 but shows lid member 142 concealed by plurality of plates 144.

Figure 24:
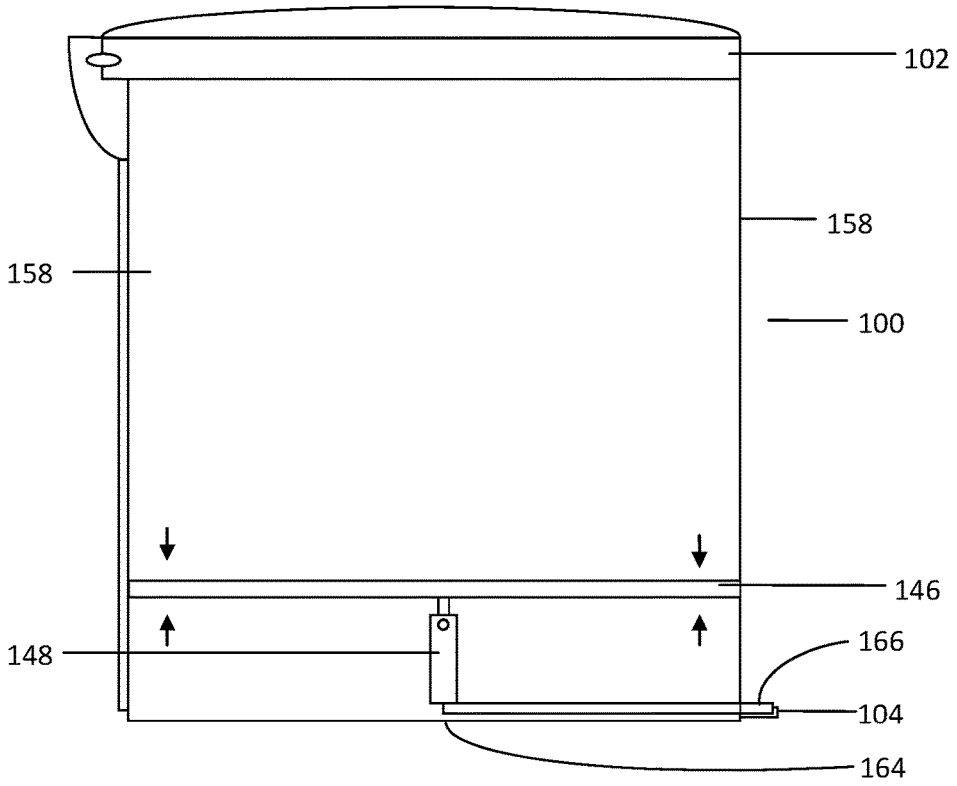
FIG. 24 is a side view of a bin.

Referring to FIG. 24, there is shown a side view of a bin 100. The bin having surrounding wall 158 and a closed bottom end 164 configured to create a base with an interior chamber. A lid 102 is connected to the top of the bin 100. A pedal 104 is configured for activating opening of the lid 102. Secured at the bottom of the interior chamber of the bin 100 is a vertical moving floor plate 146 coupled to a hydraulic driving mechanism 148. The hydraulic driving mechanism 148 coupled to a pedal 166 for activating hydraulic driving mechanism 148 to raise and lower floor plate 146 within the interior chamber of the bin 100.

Figure 25:
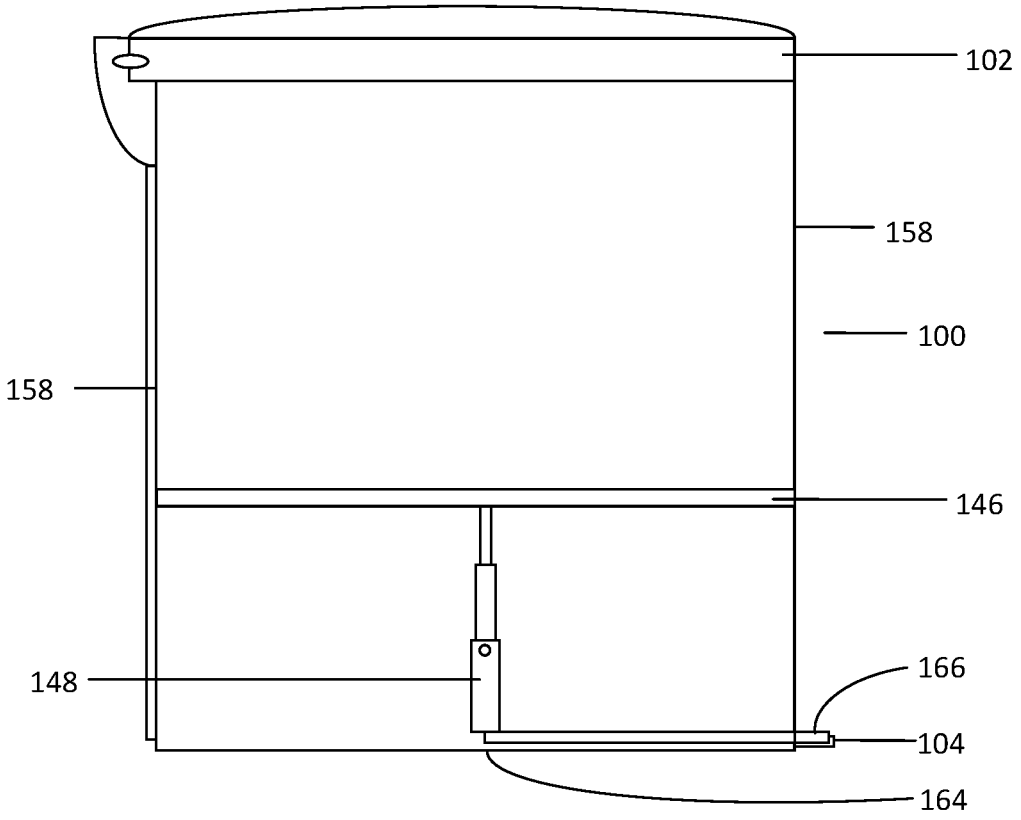
FIG. 25 is a side view of the bin of FIG. 24.

Referring to FIG. 25, there is shown a side view of the bin 100 of FIG. 24. This FIG. includes all the aspects of FIG. 24 but shows hydraulic driving mechanism 148 activated and floor plate 146 raised.

Figure 26:
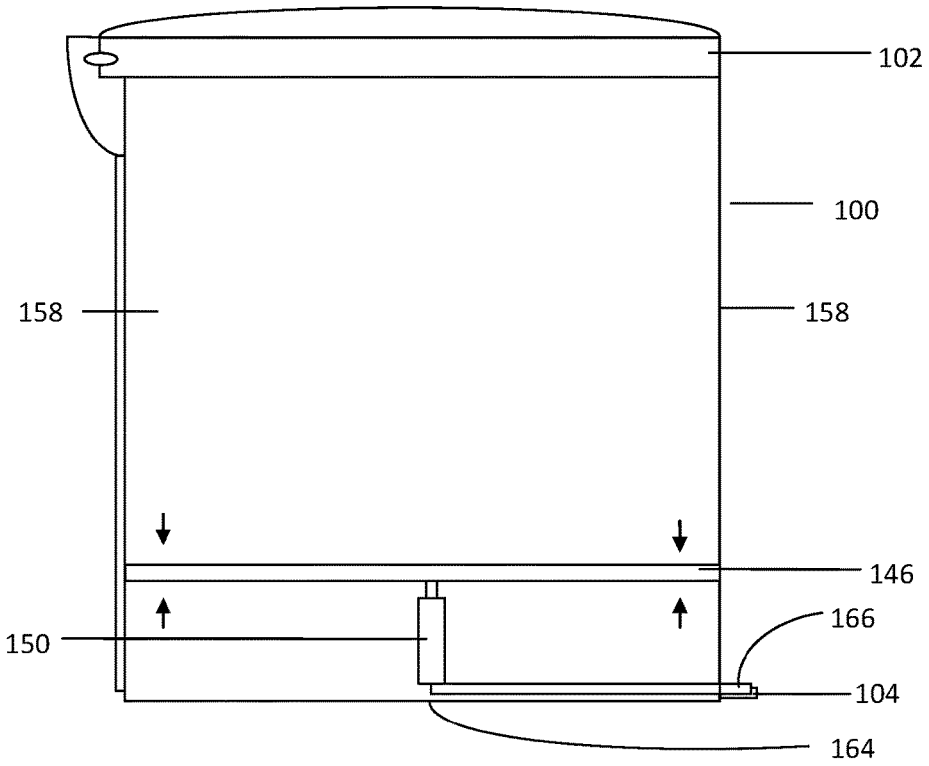
FIG. 26 is a side view of a bin.

Referring to FIG. 26, there is shown a side view of a bin 100. The bin having surrounding wall 158 and a closed bottom end 164 configured to create a base with an interior chamber. A lid 102 is connected to the top of the bin 100. A pedal 104 is configured for activating opening of the lid 102.

Secured at the bottom of the interior chamber of the bin 100 is a vertical moving floor plate 146 coupled to a pneumatic driving mechanism 150. The pneumatic driving mechanism 150 coupled to a pedal 166 for activating pneumatic driving mechanism 150 to raise and lower floor plate 146 within the interior chamber of the bin 100.

Figure 27:
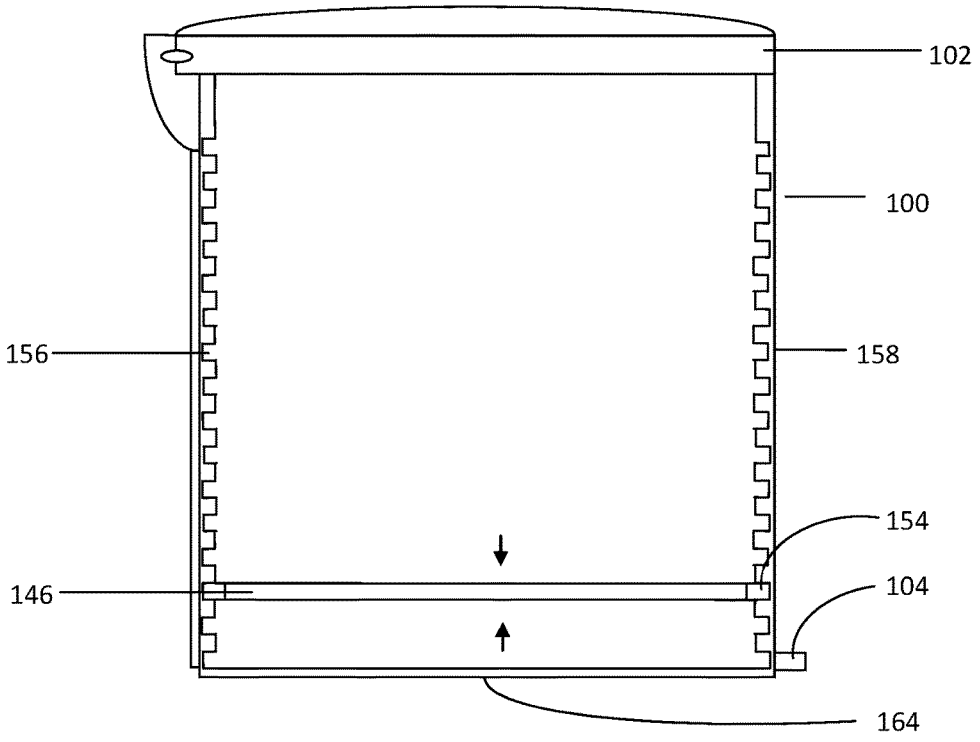
FIG. 27 is a side view of a bin.

Referring to FIG. 27, there is shown a side view of a bin 100. The bin having surrounding wall 158 and a closed bottom end 164 configured to create a base with an interior chamber. A lid 102 is connected to the top of the bin 100. A pedal 104 is configured for activating opening of the lid 102. A floor plate 146 is secured in the interior chamber of the bin 100. The bin 100 having slots 156 configured at different vertical levels of the interior chamber of the bin 100 to engage and secure floor plate 146. The floor plate 146 having a securing mechanism 154 configured to engage and disengage the floor plate 146 with the slots 156.

Figure 28:
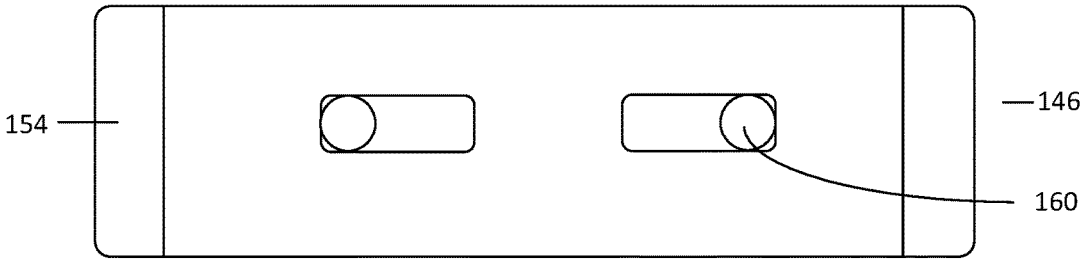
FIG. 28 is a top view of a floor plate.

Referring to FIG. 28, there is shown a top view of a floor plate 146 with securing mechanism 154 in an engaged extended position, and finger inserts 160 used to engage and disengage the securing mechanism 154.

Figure 29:
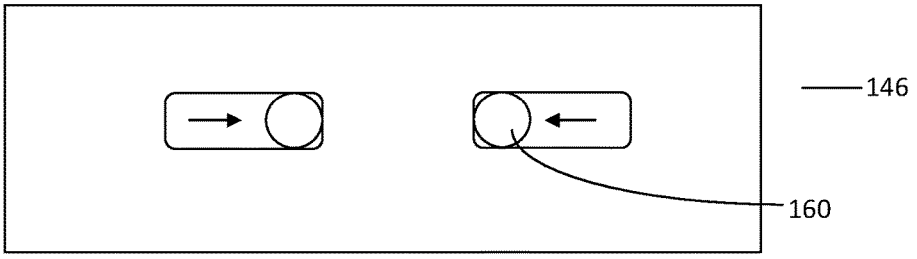
FIG. 29 is a top view of the floor plate of FIG. 29.

Referring to FIG. 29, there is shown a top view of the floor plate 146 of FIG. 28 with securing mechanism 154 in a disengaged retracted position, and finger inserts 160 used to engage and disengage the securing mechanism 154.

Figure 30:
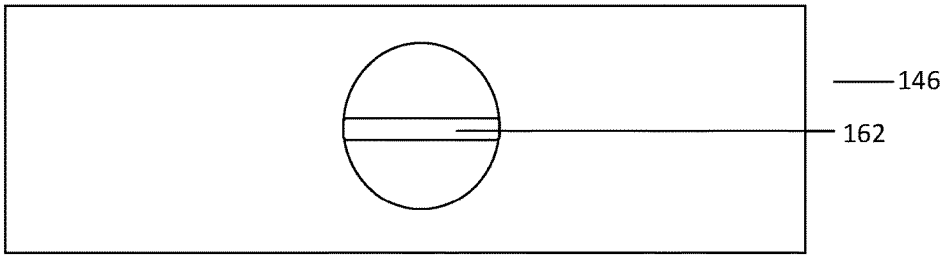
FIG. 30 is a top view of a floor plate.

Referring to FIG. 30, there is shown a top view of a floor plate 146 with securing mechanism 154 in a disengaged retracted position, and thumb-turn mechanism 162 used to engage and disengage the securing mechanism 154.

Figure 31:
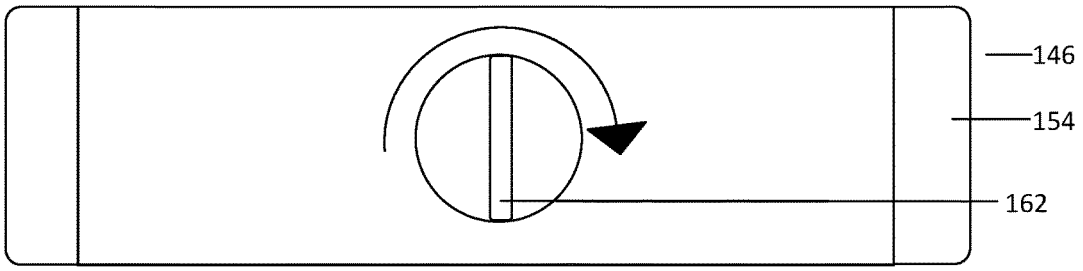
FIG. 31 is a top view of the floor plate of FIG. 31.

Referring to FIG. 31, there is shown a top view of the floor plate 146 of FIG. 30 with securing mechanism 154 in an engaged extended position, and thumb-turn mechanism 162 used to engage and disengage the securing mechanism 154.

Although the invention has been illustrated and described in the drawings and foregoing description, the same is to be considered as illustrative and not restrictive in character—it being understood that only preferred embodiments have been shown and described, and that all changes and modifications that come within the spirit of the invention as claimed are desired to be protected. Undoubtedly, many other "modifications" and "variations" on the "themes" set forth hereinabove will occur to one having ordinary skill in the art to which the present invention most nearly pertains, and such variations are intended to be within the scope of the invention, as disclosed herein. The size, shape, length, width, location and materials of the various components may vary without departing from the spirit of the invention. Many of the embodiments listed may be combined with each other to form additional embodiments of the bin and lid. The use of certain singular and plural terms like "an", "a", "it", "their", "is", "are" and similar terms while describing the present invention are to be interpreted to cover both singular and plural. The use of the term "and" while describing the present invention is to be interpreted to also cover the term "or". Furthermore, any combination of the described elements in all variations possible thereof is covered by the invention unless otherwise indicated. The terms "possessing", "having", "containing," "including," and other similar terms are to be interpreted as open-ended terms (i.e., meaning "including, but not limited to,") unless otherwise noted.

The invention claimed is:

1. A bin comprising: a surrounding wall and a closed bottom end, said surrounding wall and said closed bottom end configured to create a base with an interior chamber; a top opening to the interior chamber; at least a top portion of the bin comprising at least two slideable telescopic members; the slideable telescopic members movable between an extended position to receive a larger liner within the interior chamber and a retracted position to receive a smaller liner within the interior chamber; wherein the slideable telescopic members allows for the top opening of the bin to be adjusted in periphery; a lid pivotably connected to the bin, said lid being configured to pivot into open or closed positions, wherein the slideable telescopic members are pivotably connected to the bin and to the lid.

2. The bin of claim 1, further comprising an actuator configured for opening the lid.

3. The bin of claim 2, wherein the actuator is a pedal.

4. The bin of claim 1, further comprising a dampening mechanism configured for dampening movement of the lid at least from the open position to the closed position.

5. The bin of claim 1, further comprising at least a hooking mechanism configured on the slideable telescopic members for receiving first and second portions of a liner.

6. The bin of claim 1, wherein the slideable telescopic members are configured at least partially within the interior chamber.

7. The bin of claim 1, wherein the slideable telescopic members are configured on the periphery.

8. The bin of claim 1, further comprising at least a guide track on the bin so that the slideable telescopic members can slide relative to the guide track.

9. The bin of claim 1, wherein at least part of side wall bottoms of the slideable telescopic members is elevated to allow for the slideable telescopic members to slide relative to guide tracks.

10. The bin of claim 1, further comprising at least a roller to improve the movement of the slideable telescopic members relative to guide tracks.

11. The bin of claim 1, further comprising a lock mechanism configured to selectively secure the slideable telescopic members in a locked position.

12. The bin of claim 1, further comprising at least a flexible scrolling member coupled to the slideable telescopic members; the flexible scrolling member present in a space between the slideable telescopic members and a rest of the bin when retracted.

13. The bin of claim 12, wherein the scrolling member slides into a side wall of the bin when the slideable telescopic members are extended.

14. The bin of claim 12, wherein the scrolling member stacks in a side wall of the bin.

15. The bin of claim 12, further comprising guide tracks present to enable the scrolling member to slide relative to the guide tracks.

16. The bin of claim 15, further comprising at least a roller to improve movement of the scrolling member on the guide tracks.

17. The bin of claim 1, further comprising a plurality of plates coupled to the slideable telescopic members; the plurality of plates present in a space between the slideable telescopic members and a rest of the bin when retracted.

18. The bin of claim 17, wherein each of the plates is hingedly coupled to a leading plate.

19. The bin of claim 17, wherein each of the plates is hingedly coupled to a following plate.

20. The bin of claim 17, wherein the plurality of plates slides into a side wall of the bin when the slideable telescopic members are extended.

21. The bin of claim 17, wherein the plurality plates stacks in a side wall of the bin.

22. The bin of claim 17, further comprising guide tracks present to enable the plurality of plates to slide relative to the guide tracks.

23. The bin of claim 22, further comprising at least a roller to improve movement of the plurality of plates on the guide tracks.

24. The bin of claim 1, further comprising at least a handle configured on the slideable telescopic members for extension and retraction of the slideable telescopic members.

* * * * *